284812 0189 --00 02-19-91 45128 01-18-91 151417 78147.0 04993247 0602

United States Patent [19]

Minemura

[11] Patent Number: 4,993,247

[45] Date of Patent: Feb. 19, 1991

[54] LOCK FOR AUTOMATIC VENDING MACHINES

[75] Inventor: Toshio Minemura, Tokyo, Japan

[73] Assignee: Sanpo Lock Co., Ltd., Tokyo, Japan

[21] Appl. No.: 461,863

[22] Filed: Jan. 8, 1990

[30] Foreign Application Priority Data

Oct. 31, 1989 [JP] Japan ..... 1-235563

[51] Int. Cl.[5] ..... E05B 13/10

[52] U.S. Cl. ..... 70/208; 292/251

[58] Field of Search ..... 70/208, 360, 229, 230, 70/231, 232, DIG. 20, DIG. 27, 204; 292/251

[56] References Cited

U.S. PATENT DOCUMENTS 3,695,139 10/1972 Howe ..... 411/433 X
3,735,613 5/1973 Diebel et al. ..... 70/208
4,552,001 11/1985 Roop ..... 70/208
4,838,055 6/1989 Gallagher ..... 70/208
4,899,561 2/1990 Myers ..... 70/208

*Primary Examiner*—Lloyd A. Gall
*Attorney, Agent, or Firm*—Armstrong, Nikaido Marmelstein, Kubovcik & Murray

[57] ABSTRACT

A lock for an automatic vending machine including the combination of a bolt-and-nut locking mechanism and a slide locking mechanism. The bolt-and-nut locking mechanism includes a bolt movably mounted to the door of the vending machine to permit an associated handle to push and insert the bolt in a female-threaded hole of a nut on the casing body of the vending machine for locking at an intermediate level of the door of the vending machine. The slide locking mechanism includes a slide plate which is responsive to rotation of the bolt for sliding longitudinally until the slide plate has been caught by catching means on the casing body of the automatic vending machine, thereby locking the door to the casing body of the vending machine at upper and lower levels.

2 Claims, 12 Drawing Sheets

LOCK FOR AUTOMATIC VENDING MACHINES

BACKGROUND OF THE INVENTION

1. Field of the Invention

The present invention relates to an improvement of a lock for an automatic vending machine.

2. Related Art

Recently automatic vending machines of the type which permits the use of bills or bank notes have been popularly placed and used in the street. Such automatic vending machines are very convenient for customers. Because of a lot of money stored in automatic vending machines, however, there is an increasing tendency of inducing the crime of stealing the money in these vending machines. In almost all cases criminals use iron bars and other destructive tools to open the doors of the vending machines by force. In an attempt to prevent such crimes, strong locks as shown in FIGS. 15 and 16 have been proposed and actually used.

FIG. 15 shows such a strong lock A′ for vending machines as comprising cylindrical lock 4′ fixed to the door $m_2'$ of a vending machine and having a slide plate 18′.

The slide plate 18′ is responsive to rotation of the cylinder of the cylindrical lock 4′ for moving longitudinally until the slide plate 18 ′ has been caught by upper and lower catch pieces 19′, which are fixed to the casing body $m_1'$. Thus, the door $m_2'$ of the vending machine is closed and locked to the casing body $m_1'$ of the vending machine at its upper and lower levels. This type of lock using a slide plate latch, however, has clamping force insufficient to prevent the door from being opened by force.

FIG. 16 shows another strong lock A′ for vending machines as comprising a nut or female member 1′ fixed to the casing body $m_1'$ of a vending machine and a rotatable bold or male member 5′ fixed to the door $m_2'$ of the vending machine. After closing the door $m_2'$, the rotatable bolt 5′ is rotated and driven into the nut 1′ until the door is firmly locked to the casing of the vending machine at its intermediate level. This bolt-and-nut type of lock has sufficient clamping force, but the door can be opened by inserting an iron bar into the gap between the door and the casing body of the vending machine at its upper and lower levels and by tearing up the door from the casing body of the vending machine.

SUMMARY OF THE INVENTION

In view of the above the object of the present invention is to provide an improved lock for an automatic vending machine which is free of the drawbacks as described above, assuring reliable locking of the vending machine.

To attain this object a lock for an automatic vending machine comprising a nut or female assembly fixed to the casing body of said automatic vending machine; a handle housing fixed to the door of said automatic vending machine; a bolt or male assembly movably fixed to said handle housing to permit advance and thread-engagement with said nut or female assembly; a handle spring-biased outward from said handle housing and equipped with a cylindrical latchkey to permit locking or unlocking of said handle to said handle housing in response to locking or unlocking operation of said cylindrical latchkey, is improved according to the present invention in that it further comprises a slide locking mechanism comprising a slide plate which is responsive to rotation of said bolt or male assembly caused by rotation of said handle for sliding longitudinally until said slide plate has been caught by catching means on the casing body of said automatic vending machine, and that said handle is equipped with coupling means which is responsive to the unlocking of said handle from said handle housing for permitting said handle to spring out of said handle casing and at the same time, connect to said bolt or male assembly for rotating and driving said bolt or male assembly into said nut or female assembly. Preferably said nut or female assembly comprises a cylindrical holder having a convergent hole for guiding said bolt or male assembly and a consecutive divergent hole, and a plurality of nut segments each having threads and arranged in said divergent hole so as to yieldingly expand around said bolt or male assembly, encircle and threadedly engage with said bolt or male assembly when inserted and driven into said nut or female assembly.

In use, the door is closed, and then the handle is rotated to drive the bolt into the nut, and at the same time, cause the slide locking mechanism to longitudinally move the slide plate until it has been caught by the upper and lower catching means. Thus, the door can be firmly locked to the casing of the vending machine at its upper, intermediate and lower levels, preventing insertion of an iron bar into the gap between the door and the casing body of the vending machine and the tearing-up of the door.

Even if the bolt is not in exact alignment with the nut, as the door is closing, the bolt can be inserted in the convergent guide hole of the nut to be automatically guided to expandable female-threaded sectors.

Other objects and advantages of the present invention will be understood from the following description of a preferred embodiment of the present invention, which is shown in accompanying drawings:

PREFERRED EMBODIMENTS OF THE INVENTION

Figure 1:
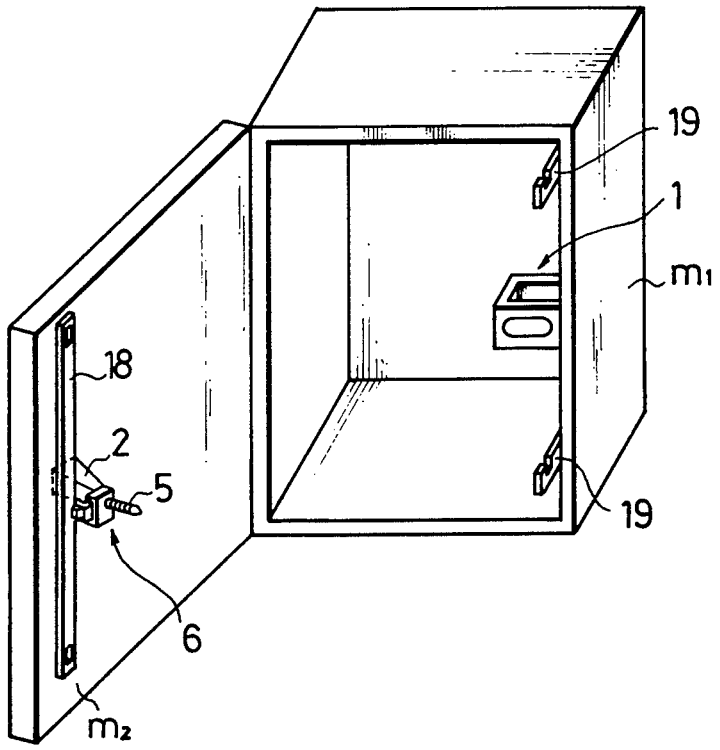
FIG. 1 is a perspective view of an automatic vending machine equipped with a lock according to the present invention, the vending machine unlocked and its door being open.
Figure 2:
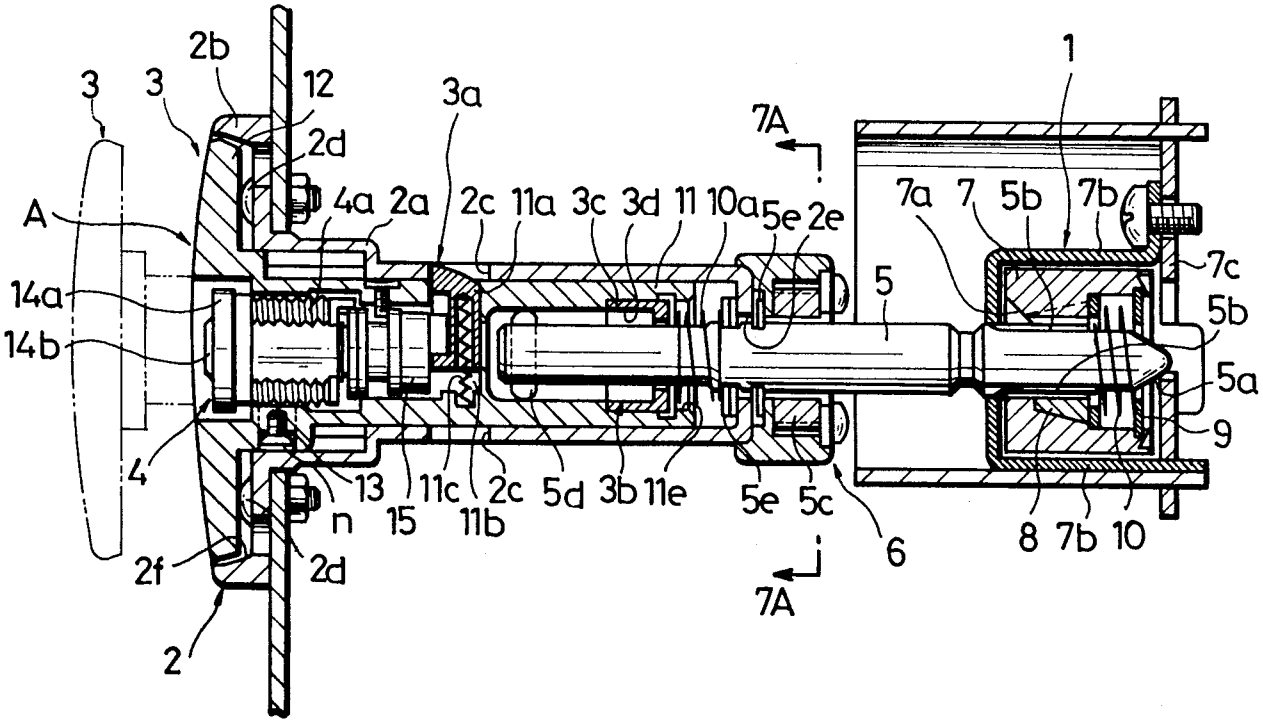
FIG. 2 is a longitudinal section of a lock according to one embodiment of the present invention.
Figure 3:
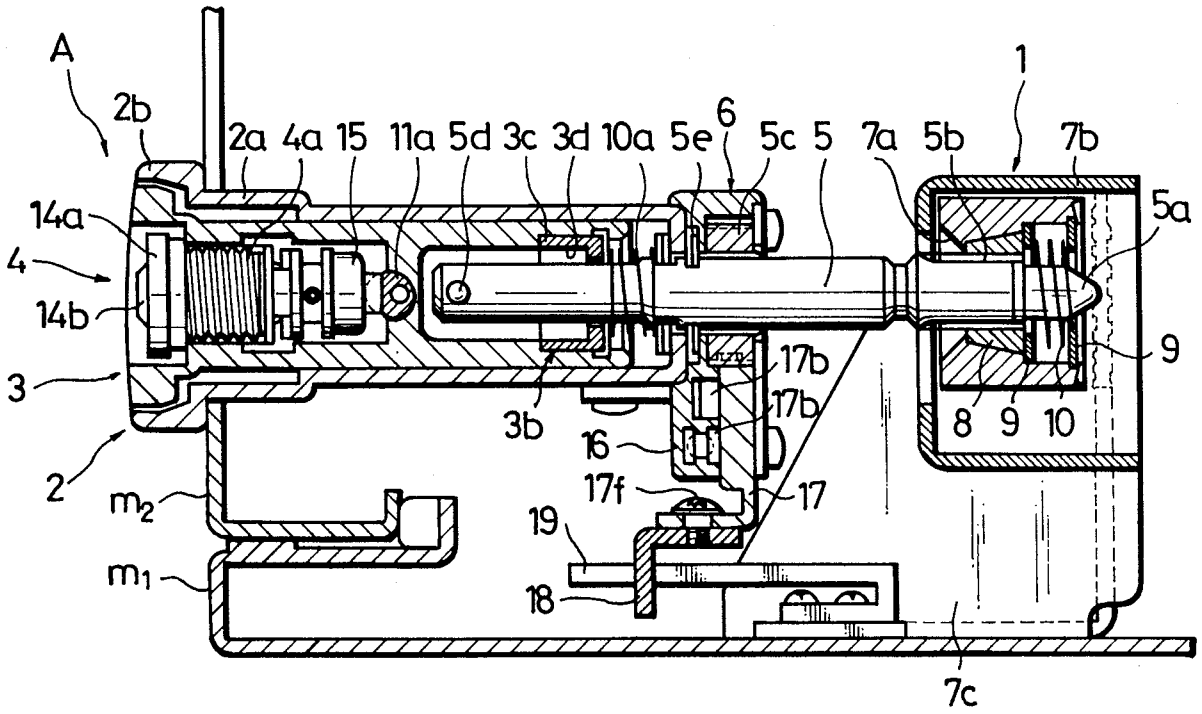
FIG. 3 is a longitudinal section of the lock of FIG. 1 cut straight in a direction perpendicular to that in which the lock is cut straight and is shown in FIG. 2.

Referring to FIG. 1, an automatic vending machine equipped with a lock according to the present invention is shown. The vending machine is unlocked and its door is open. FIGS. 2 and 3 show a lock according to one embodiment of the present invention in crosswise longitudinal sections.

As seen from FIGS. 2 and 3, the lock A comprises a nut assembly 1 fixed to the casing body $m_1$ of the vending machine with the aid of associated bracket 7*c*, a handle housing 2 fixed to the door $m_2$ of the vending machine by means of bolts, a handle 3 slidably fitted in the handle housing and spring-biased to spring out from the handle housing when released, a cylindrical latchkey 4 to unlock and release the handle 3 with the aid of an associated key, a bolt 5 accommodated in the handle housing 2 and partly appearing from the rear end of the handle housing 2 for threadedly engaging with the nut assembly 1, and a slide locking mechanism 6 which is responsive rotation of the handle 3 and hence the bolt 5 for moving an associated slide plate 18 longitudinally until it has been caught by catch pieces 19 on the casing body $m_1$ of the vending machine.

Figure 4A:
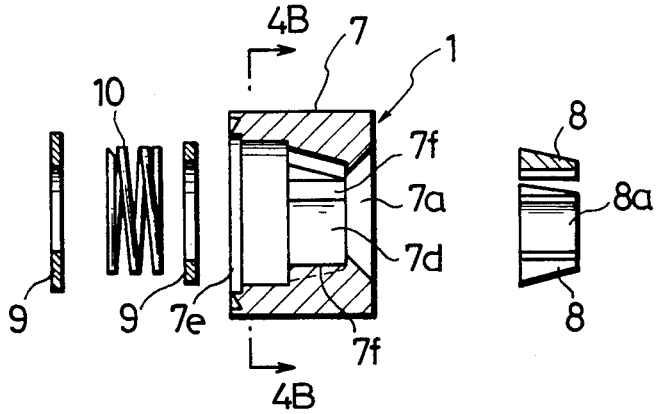
FIG. 4A is an exploded sectional view of a nut or female assembly.
Figure 4B:
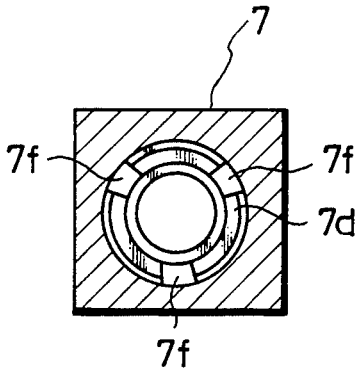
FIG. 4B is a cross section taken along the line 4B—4B in FIG. 4A and viewed in the direction indicated by arrows.
Figure 4C:
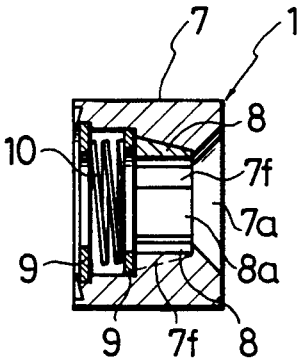
FIG. 4C is a longitudinal section of the nut assembly.
Figure 4D:
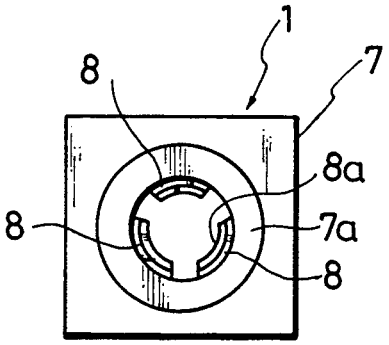
FIG. 4D is a front view of the nut assembly.

FIG. 4A is an exploded sectional view of the nut assembly; FIG. 4B is a cross section taken along the lines 4B—4B is FIG. 4A; FIG. 4C is longitudinal section of the nut assembly; and FIG. 4D is a front view of the nut assembly.

The nut assembly comprises a square holder 7 having a convergent hole 7*a* for guiding the bolt 5 at one end a consecutive divergent hole 7*d*, a straight hole 7*e* at the other end of the holder, and a plurality of nut segments 8 each having threads and arranged in the divergent hole so as to yieldingly expand around the bolt 5 and encircle and threadedly engage with the bolt 5 upon insertion into the nut assembly.

Three guide pieces 7*f* are fixed longitudinally on the inside surface of the divergent hole 7*d* at equi-angular intervals. Three nut segments 8 are slidably fitted in between adjacent guide pieces 7*f*, and a washer 9 and a compression spring 10 are fitted in the straight hole 7*e*. Each nut segment 8 has a slant upper edge in conformity with the inside surface of the divergent hole 7*d*, and under the influence of the compression spring 10 each nut segment is pushed against the boundary at which the divergent and convergent holes 7*d* and 7*a* meet. The nut segments 8 are caught by the riser among the boundary so that they cannot slip out from the convergent hole 7*a* at the other end of the nut assembly. The nut assembly 1 is fixed to the casing body $m_1$ of the vending machine with the aid of associated enclosure 7*b* and bracket 7*c*, thus preventing rotation and axial displacement of the nut assembly 1. Insertion of the bolt 5 in the convergent guide hole 7*a* causes expansion of the surrounding nut sectors in the divergent hole 7*d* to define a threaded hole 8*a* encircling and threadedly engaging with the advancing bolt end, thus preventing withdrawal of the bolt 5 from the nut hole.

In place of such a nut assembly as described above, a conventional nut or a two-ridge nut may be used.

Figure 5A:
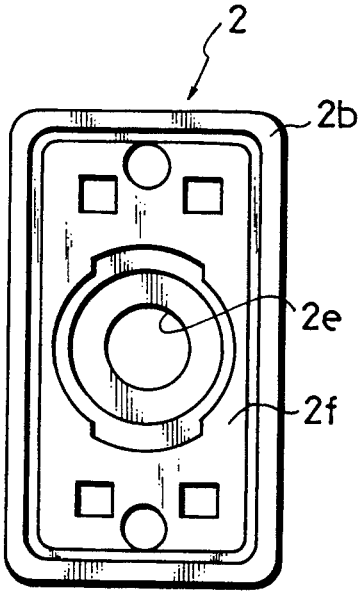
FIG. 5A is a front view of a handle housing.
Figure 5B:
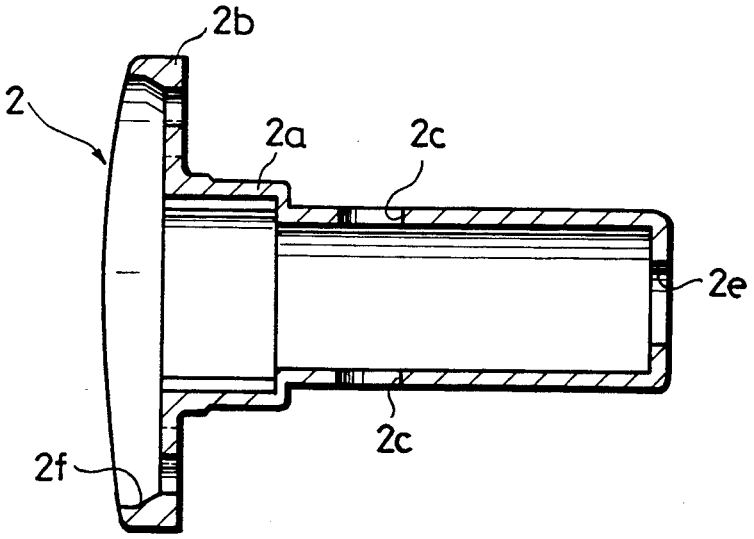
FIG. 5B is a longitudinal section of the handle housing.

FIG. 5A is a front view of the handle housing, and FIG. 5B is a longitudinal section of the handle housing.

The handle housing 2 is in the space of T, consisted of a hollow circular cylinder 2*a* and a rectangular head 2*b* integrally connected to one end of the hollow circular cylinder 2*a* and extending perpendicular thereto. The hollow circular cylinder 2*a* has locking apertures 2*c* made in the hollow circular cylinder 2*a* in the vicinity of the lateral head 2*b* and an aperture 2*e* made in the bottom of the hollow circular cylinder 2*a* for insertion of the bolt 5. The lateral head 2*b* has a space 2*f* to accommodate the grip 3, and the handle housing 2 is fixed to the door $m_2$ of the vending machine with the inside of the lateral head laid on the outside of the door $m_2$ of the vending machine.

Figure 6A:
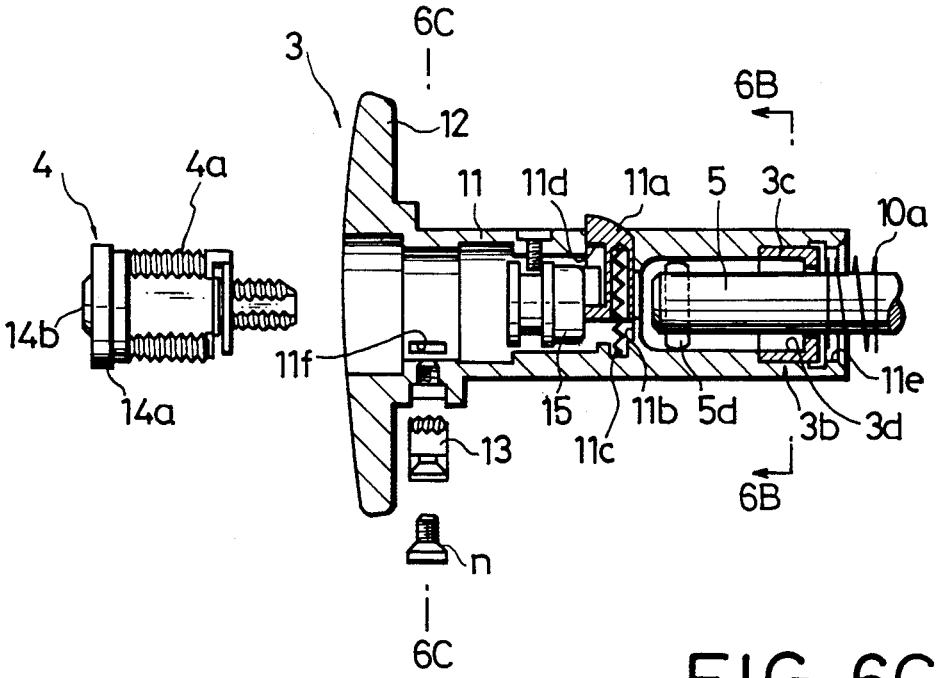
FIG. 6A is a longitudinal section of a handle with its cylindrical latchkey removed.
Figure 6B:
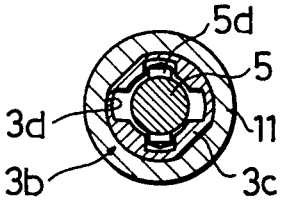
FIG. 6B is a cross section taken along the lines 6B—6B in FIG. 6A and viewed in the direction indicated by arrows.
Figure 6C:
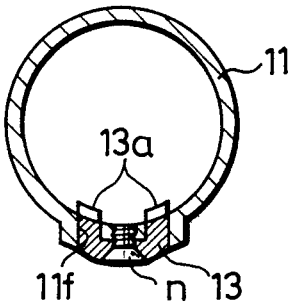
FIG. 6C is an enlarged cross section taken along the line 6C—6C in FIG. 6A.
Figure 6D:
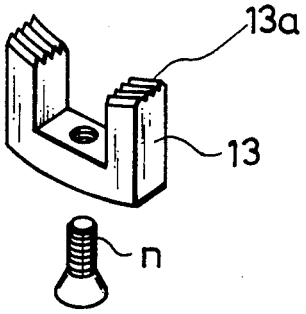
FIG. 6D is an enlarged perspective view of a hold metal piece.

FIG. 6A is a longitudinal section of the handle 3 with its cylinder latchkey 4 removed; FIG. 6B is a cross section taken along the line 6B—6B in FIG. 6A; FIg. 6C is an enlarged cross section taken along the line 6C—6C in FIG. 6A; and FIG. 6D is an enlarged perspective view of the hold metal piece 13.

The handle 3 is in the shape of T, consisting of a hollow circular cylinder 11 which is sized so as to be loosely inserted in the hollow cylinder 2*a* of the handle housing 2, and a grip 12 integrally connected to one end of the hollow circular cylinder 11 and extending perpendicular thereto. The handle 3 is pushed in the hollow cylinder 2*a* of the handle housing 2 against the resilient force of compression spring 10*a*. The handle 3 has a latch 3*a* to permit the handle 3 to be fixed to the handle housing 2 at a predetermined position. The handle 3 has a catch section 3*b* to permit a cross pin 5*d* which is fixed to the inner end of the bolt 5, to fit in the crosswise recesses of the catch section when the handle 3 is allowed to spring out from the lateral head 2*b* of the handle housing 2*a*. The handle 3 has a cylindrical latchkey 4 to be operated with a key (not shown).

The hollow circular cylinder 11 has an insertion aperture 11*e* on its bottom end. The inner end of the bolt 5 is inserted in the hollow circular cylinder 11 through its insertion aperture 11*e*.

The latch 3*a* comprises a spring-biased nail 3*a*, which is slidably fitted in the lateral space 11*b* of the circular cylinder 11 of the handle 3, and is urged outward by a compression spring 11*c*. The cylindrical latchkey 4 has a cam 15 detachably fixed thereto. The cam 15 is fitted in the recess lid of the nail 3*a*. In locking operation the key is inserted in the key hole of the cylindrical latchkey 4 to rotate the cam 15 and put the spring-biased nail 11*a* in locking position in which the nail 11*a* may be allowed to spring out from the aperture 2*c* of the hollow cylinder 2*a* of the handle housing 2 when the nail 11*a* is put in alignment with the aperture 2*c* of the hollow cylinder 2*a*. Then, the grip 12 is pushed in the space 2*f* of the lateral head 2*b* of the handle housing 2 until the nail 3*a* is put in alignment with the aperture 2*c* of the hollow cylinder 2*a* of the handle housing 2, thereby allowing the nail 11*a* to spring out, thus being caught in the aperture 2*c* of the hollow cylinder 2*a* of the handle housing 2. In unlocking operation the key is inserted in the key hole of the cylindrical lock 4 to rotate the cam 15 and withdraw the spring-biased nail 11*a* from the aperture 2*c* of the hollow cylinder 2*a* against the compression spring 11*c*. Then, the handle 3 is allowed to automatically spring out from the handle housing 2 under the influence of the compression spring 10*a* (See FIG. 12).

The catch section 3*c* is attached to the rear end of the hollow circular cylinder 11, and the catch section 3*c* has a crosswise indentations 3*d* to allow the cross pin 5*d* of the bolt 5 to fit in the opposite indentations 3*d* when the handle 3 is unlocked, thereby integrally connecting the bolt 5 to the handle 3 to permit the bolt 5 to rotate simultaneously with the handle 3 (See FIG. 6B).

The latchkey 4 is composed of an outer cylinder 14*a* having threads 4*a* to permit an associated hold metal piece 13 to engage with the outer cylinder 14*a*, and an inner cylinder 14*b* rotatably telescoped in the outer cylinder 14*a* and having a cam 15 fixed to the rear end of the inner cylinder 14*b*. The inner cylinder 14*b* has a key hole and opposite recesses made in radial directions which are perpendicular to the key hole, each recess has a tumbler slidably fitted therein. Insertion and rotation of a key in the key hole will cause the tumblers to yieldingly withdraw, and will cause the inner cylinder to rotate, thereby causing the nail 11*a* to rise or descend.

A hold metal piece 13 is in the shape of "U", and each top end 13*a* of the opposite legs of the "U"-shaped metal piece has threads, as best seen in FIG. 6D. The hold metal piece 13 can be attached to the hollow circular cylinder 11 with its opposite legs slidably fitted in slots 11*f* made in the hollow circular cylinder 11, and then it can be fixed by a fastening bolt "n". When the fastening bolt "n" is driven, the hold metal piece 13 will be raised until its opposite top ends have come to threadedly engage with the threads 4*a* of the outer cylinder 14*a* of the latchkey 4. When occasions demand, two hold metal pieces may be used in radially opposite positions across the hollow circular cylinder 11.

When it is desired that the latchkey 4 is changed for a new one, the fastening bolt "n" is loosened to lower the hold metal piece 13 until its opposite top ends have left the threads 4*a* of the outer cylinder 14*a* of the latchkey 4.

Then, the latchkey 4 can be removed from the hollow cylinder 11 of the handle 3 (See FIG. 6A).

The bolt assembly 5 comprises an elongated round rod having a conical top 5*a*, male threads 5*b* in the vicinity of the conical top 5*a*, a pinion 5*c* at the intermediate position of the rod, and a pin 5*d* fixed to and extending perpendicular to the longitudinal axis of the rod in the vicinity of the rear end of the rod. The bolt assembly 5 is rotatably fixed to the bottom of the hollow cylinder 2*a* of the handle housing 2 by "E"-rings 5*e*. The rear end and consecutive length of the rod 5 is inserted in the hollow cylinder 2*a* of the handle housing 2, and the remaining length including the conical top 5*a* and male threads 5*b* appears outside from the hollow cylinder 2*a* of the handle housing 2.

The handle 3 is pushed in the handle housing 2, while the conical top 5*a* and consecutive length of the rod 5 are allowed to appear outside of the handle housing 2. When the handle 3 appears out of the hollow cylinder 2*a* of the handle housing 2, the cross pin 5*d* is fitted in opposite indentations 3*d* made in the catch section 3*b*.

Figure 7A:
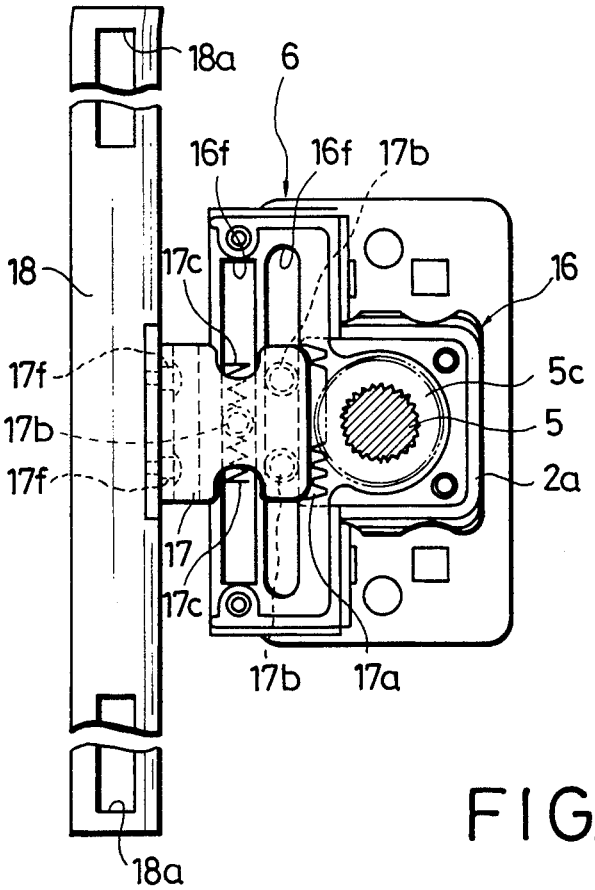
FIG. 7A is a cross section of a slide locking mechanism taken along the line 7A—7A in FIG. 2 and viewed in the direction indicated by arrows, although partly omitted.
Figure 7B:
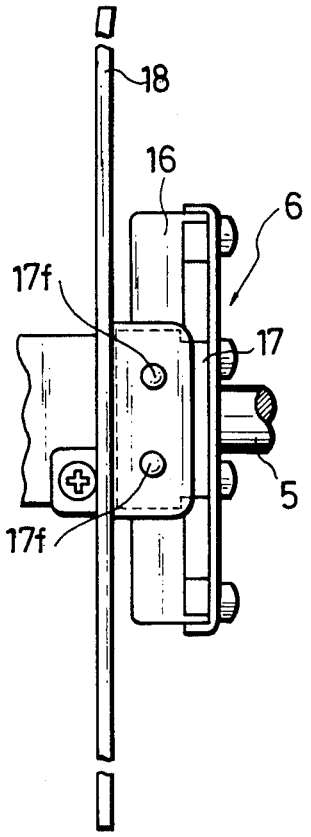
FIG. 7B is a side view of the slide locking mechanism partly omitted.
Figure 7C:
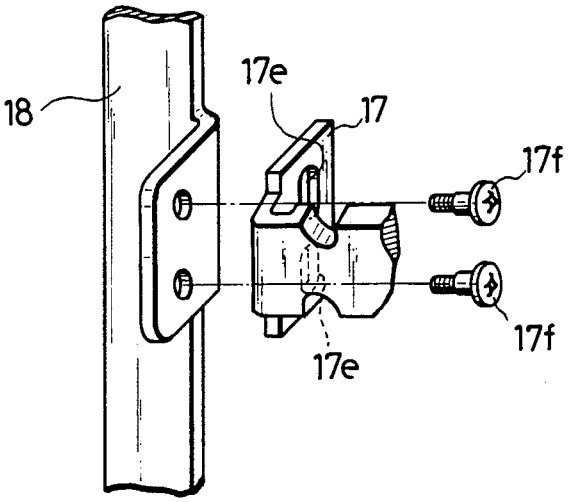
FIG. 7C is an exploded perspective view of a slide plate and associated parts.
Figure 8A:
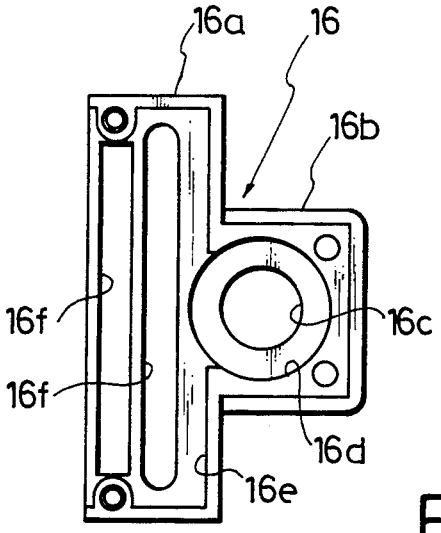
FIG. 8A is a front view of a guide.
Figure 8B:
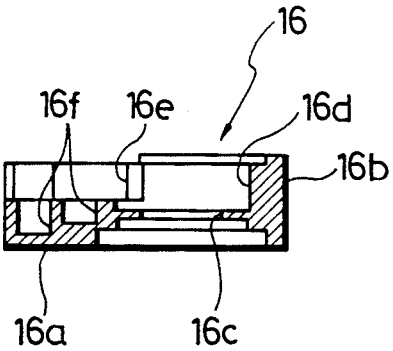
FIG. 8B is a cross section of the guide.
Figure 9A:
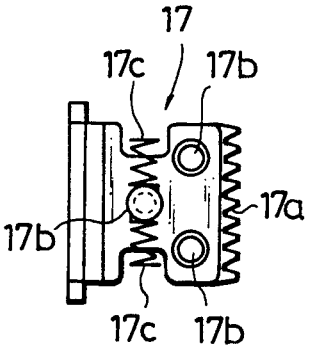
FIG. 9A is a front view of a slidable mount.
Figure 9B:
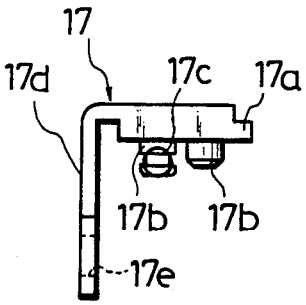
FIG. 9B is a plane view of the slidable mount.
Figure 9C:
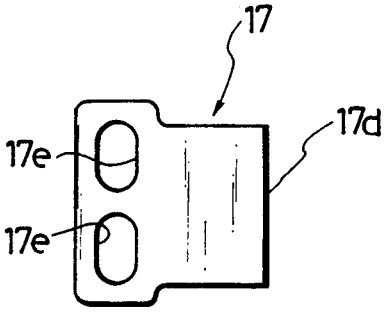
FIG. 9C is a side view of the slidable mount.

FIG. 7A is a cross section of a slide locking mechanism taken along the line 7A—7A in FIG. 2 and viewed in the direction indicated by arrows; FIG. 7B is a side view of the slide locking mechanism partly omitted; and FIG. 7C is an exploded perspective view of a slide plate and associated parts. FIG. 8A is a front view of a guide; FIG. 8B is a cross section of the guide; FIG. 9A is a front view of a slidable mount; FIG. 9B is a plane view of the slidable mount; and FIG. 9C is a side view of the slidable mount.

The slide locking mechanism 6 comprises a guide plate 16 fixed to the bottom end of the cylinder 2*a* of the handle housing 2, and a slide piece 17 slidably fitted in the guide plate 16. As best shown in FIGS. 9A, 9B and 9C, the slidable mount 17 is an "L"-shaped metal having three studs 17*b* and tooth 17*d* on one plane of the slidable mount 17 and two oval apertures 17*e* made in the other plane of the slidable mount 17. As best shown in FIG. 9A, one stud 17*b* and two studs 17*b* are arranged in parallel relationship at the same interval as the two longitudinal slots 16*f* of the guide plate 16. The one stud 17*b* has a spring 17*g*. The slide plate 18 is fixed to the slidable mount 17 by bolts 17*f*, as best seen in FIG. 7C.

The guide plate 16 comprises a square slide mount 16*b* having a circular aperture 16*c* made therein, and a rectangular slide mount 16*e* having two longitudinal slots 16*f* made therein, and integrally connected to one side of the square slide mount 16*e*. The guide plate 16 is bolted to the bottom end of the handle housing 2. The bolt 5 passes through the circular aperture 16*c*. The pinion 5*c* of the bolt assembly 5 is contained in the pinion container 16*d* of the guide plate 16, and the slidable mount 17 is attached to the rectangular slide mount 16*e* of the guide plate 16 with the teeth of the slidable mount 17 meshed with the pinion 5*c* of the bolt assembly 5, thereby permitting the slidable mount 17 and hence the slide plate 18 to slide along the longitudinal slot 16*f* of the rectangular slide mount 16*e* when the bolt assembly 5 rotates. The spring 17*c* applies force to the rack 17*a* of the slidable mount 17 to push the rack 17*a* against the pinion 5*c* at all times, thereby preventing disengagement of the rack 17*a* from the pinion 5*c*.

The slide plate 18 has upper and lower apertures 18*a*. These apertures will catch the upper and lower catch pieces 19 fixed to the casing body $m_1$ of the vending machine when the door $m_2$ of the vending machine is closed and when the handle 3 is rotated to move longitudinally the slide plate 18, thus locking the vending machine.

Figure 10:
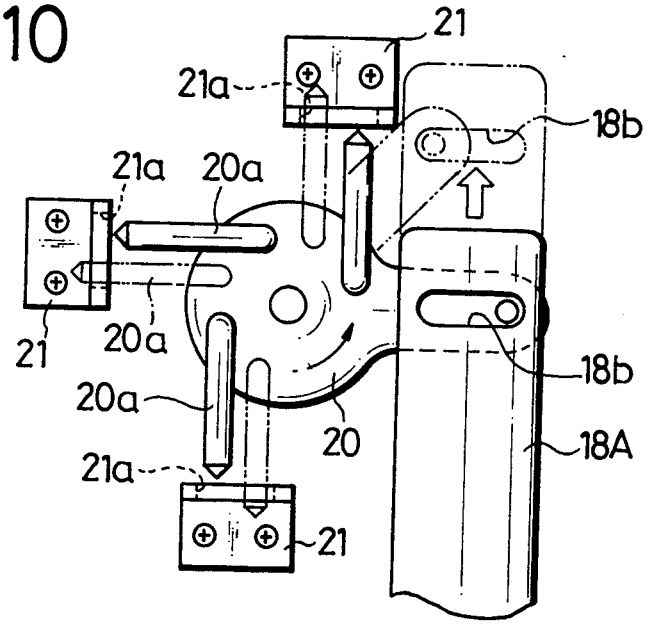
FIG. 10 shows how a sliding clamp works.
Figure 11A:
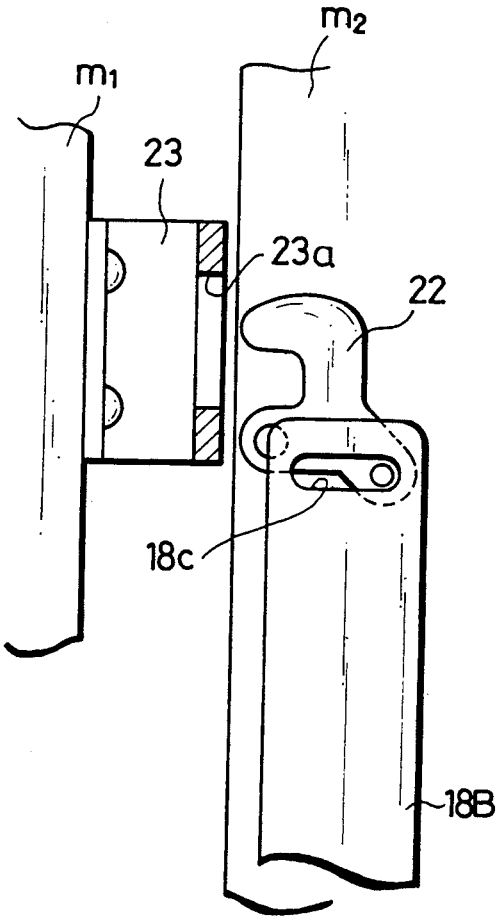
FIG. 11A and 11B show how another siding clamp works.
Figure 11B:
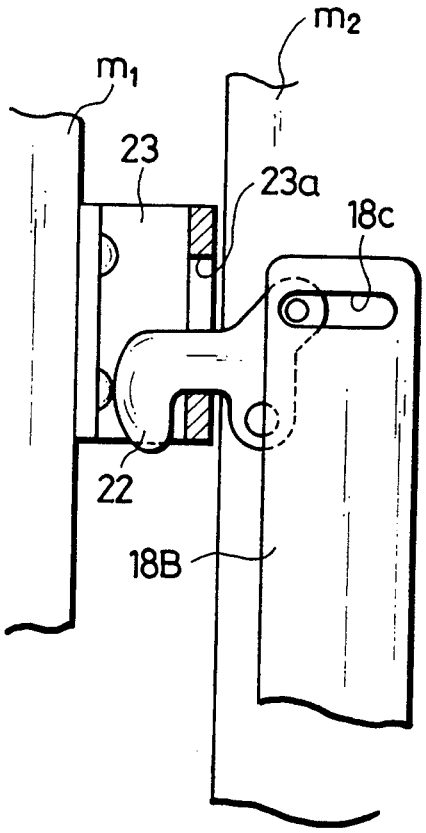

FIG. 10 shows how a sliding clamp works; and FIGS. 11A and 11B show how another sliding clamp works.

In either case the slide plate has latch plates. As shown in FIG. 10 a latch plate 20 has three latchpins 20*a* and a stud fixed thereto, and is rotatably fixed to the door $m_2$ of the vending machine. A slide plate 18A has upper and lower lateral slots 18*b* in the vicinity of the opposite ends of the slide plate 18A, and the slide plate 18A is longitudinally movably fixed to the door $m_2$ of the vending machine. The rotatable latch plate 20 is operatively connected to the slide plate 18A by inserting the stud of the rotatable latch plate 20 in the lateral slot 18*b* of the slide plate 18A. Three catch pieces 21 each having a catch aperture 21*a* are fixed to the casing body $m_1$ of the vending machine at such an upper or lower position hat the three latchpins 20*a* may be inserted in the apertures 21*a* of the three catch pieces 21 when the slide plate 18A is moved upward to rotate the rotatable latch plate 20 (broken lines). In operation the handle 3, and hence the bolt assembly 5 coupled with the handle 3 is rotated to cause the slide plate 18A to move upward, accordingly rotating each latch plate 20 to allow its latchpins 20*a* to get in the apertures 21*a* of the catch pieces 21. Then, the door of the vending machine is locked.

Referring to FIG. 11, each latch plate 22 has a hook portion and a stud, and is rotatably fixed to the door $m_2$ of the vending machine. A slide plate 18B has upper and lower lateral slots 18*c* in the vicinity of the opposite ends of the slide plate 18B, and the slide plate 18B is longitudinally movably fixed to the door $m_2$ of the vending machine. The rotatable latch plate 22 is operatively connected to the slide plate 18B by inserting the stud of the rotatable latch plate 22 in the lateral slot of the slide plate 18B. A catch piece 23 each having a catch aperture 23*a* is fixed to the casing body $m_1$ of the vending machine at such an upper or lower position that the hook portion of each rotatable latch plate 22 may be inserted in the aperture 23*a* of the catch piece 23 when the slide plate 18B is raised to rotate the rotatable latch plate 22. In operation the handle 3, and hence the bolt assembly 5 coupled with the handle 3 is rotated to cause the slide plate 18A to rise, accordingly rotating each latch plate 22 anticlockwise to allow its hook portion to get in the aperture 23*a* of the catch piece 23 (FIG. 11B). Then, the door of the vending machine is locked.

Figure 12:
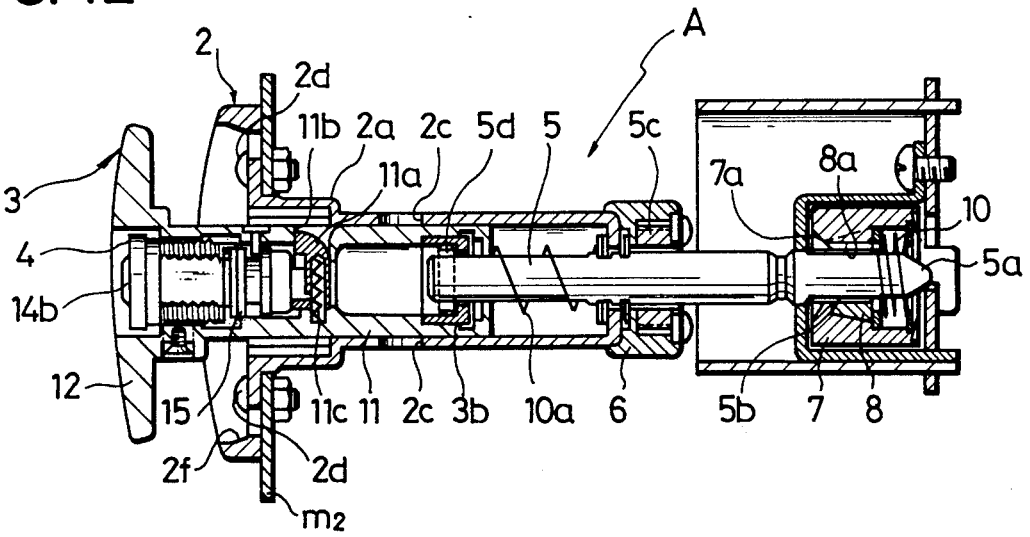
FIG. 12 is a longitudinal section of the lock with its handle projecting outward.
Figure 13A:
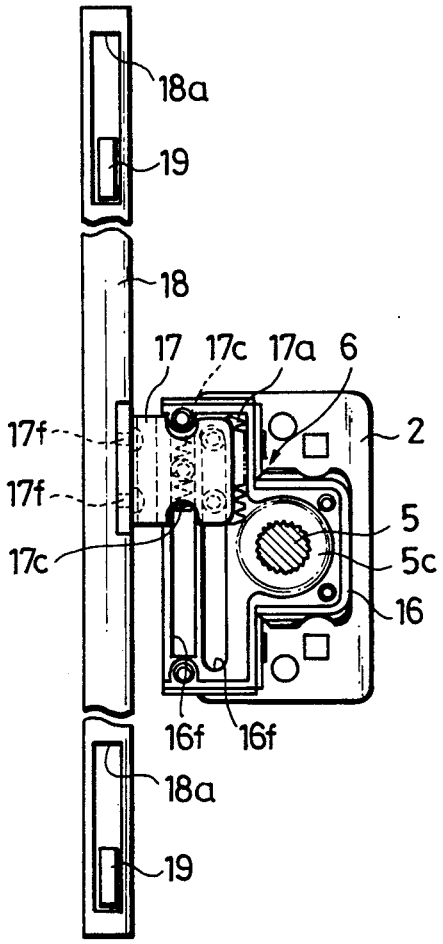
FIGS. 13A, 13B and 13C and FIGS. 14A, 14B and 14C show how the slide lock work.
Figure 13B:
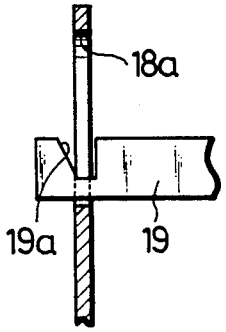
Figure 13C:
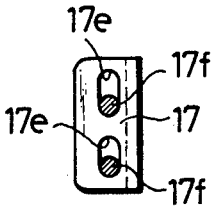
Figure 14A:
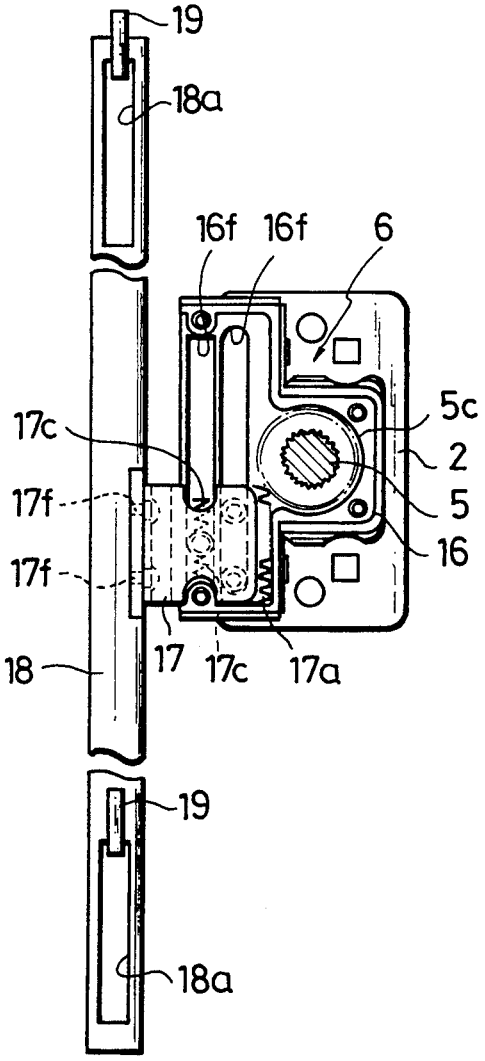
Figure 14B:
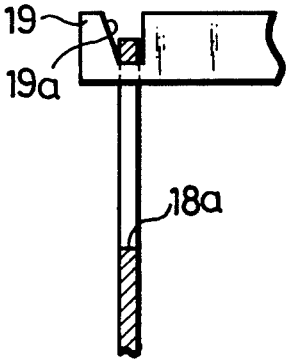
Figure 14C:
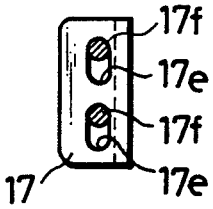
Figure 15:
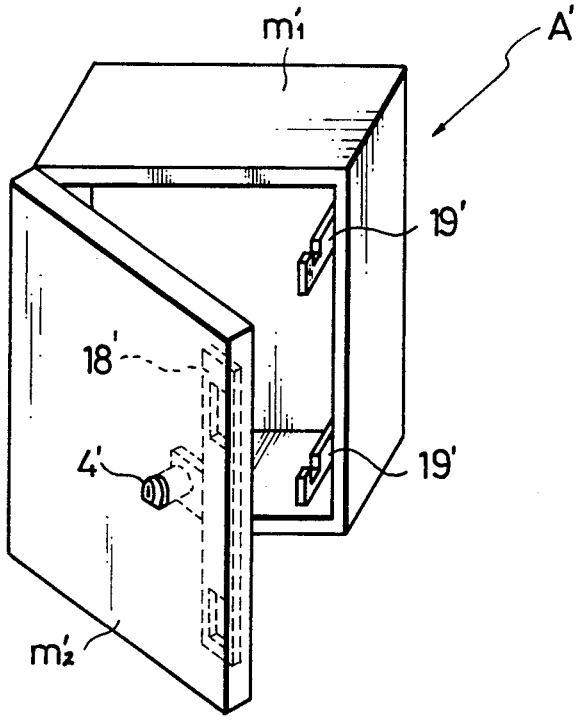
FIG. 15 PRIOR ART
FIG. 15 is a perspective view of an automatic vending machine equipped with a conventional slide lock.
Figure 16:
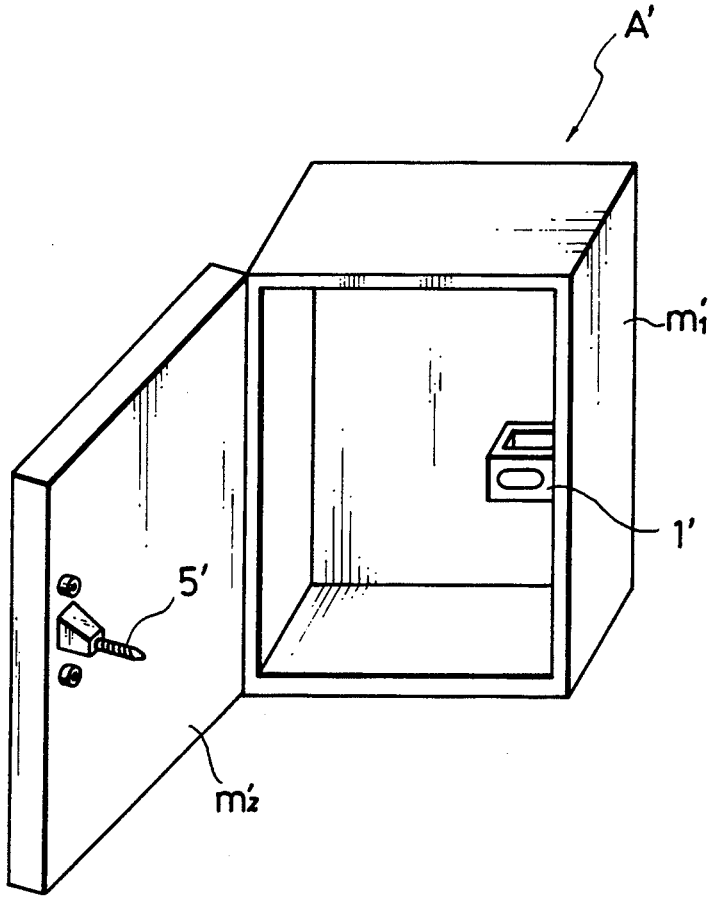
FIG. 16 PRIOR ART
FIG. 16 is a perspective view of an automatic vending machine equipped with a conventional bolt-and-nut lock.

Referring the FIGS. 12, 13 and 14, the operation of the lock according to the present invention is described below. FIG. 12 is a longitudinal section of the lock with its handle projecting outward; FIGS. 13A, 13B and 13C and FIGS. 14A, 14B and 14C show how the slide lock works.

First, the locking operation is described. The door $m_2$ is open, and then the handle 3 projects from the handle housing 2. In this position the handle 3 is coupled with the bolt assembly 5 with the cross pin 5*d* of the bolt assembly 5 engaged with the catch section 3*b* of the handle 3, thus permitting rotation of the bolt assembly simultaneous with rotation of the handle 3.

When the door $m_2$ is closed, the conical top 5*a* of the bolt assembly 5 is inserted in the convergent guide hole 7*a* of the cylindrical holder 7 to advance and enter the space 8*a* defined by the nut segments 8 in the divergent hole of the cylindrical holder 7, pushing the nut segments 8 backward against the compression spring 10 to cause the nut segments 8 to expand and encircle the bolt 5. Thus, the male-thread section of the bolt 5 is engaged with the female section defined by the nut segments 8, requiring almost no turning of the bolt (FIG. 12).

The slide plate 18 is put in condition in which the upper and lower catch means 19 on the casing body $m_1$ are inserted in the upper and lower slots 18*a* of the slide plate 18. In this position the slide lock is not used (FIGS. 13A and 13B).

The rack 17*a* of the slidable mount 17 is not engaged with the pinion 5*c*, but the leading edge of the rack 17*a* is pushed against the pinion 5*c* by the spring 17*c* for initial engagement, thereby putting the slidable mount 17 in standby condition in which slight rotation of the pinion 5*c* may cause the pinion 5*c* to engage with the rack 17*a* of the slidable mount 17. This standby condition can be provided by rotating the pinion 5*c* anticlockwise in FIG. 13A, thereby causing the slidable mount 17 to descend a distance corresponding to the longitudinal length of each elliptic hole 17*e* of the slidable mount 17 as shown in FIG. 13C and FIG. 14C.

When the handle 3 projecting from the handle housing 2 is rotated, the bolt assembly 5 which is now coupled with the handle 3 via the catch section 3*b* of the handle 3, rotates and advances until he male threads 5*b* of the bolt 5 have engaged with the nut segments 8*a*. At the same time the side plate 18 is lowered until the catching means 19 have been caught by the upper and lower slots 18*a* of the slide plate 18. The opposite ends of the slide plate 18 are pulled inside by the force which is caused by making each end of the slide plate 18 to descend on the slant 19*a* of the slant notch of the catching arm 19 (FIG. 14A and 14B). The nut segments 8 constitute a two-ridge nut, and therefore the bolt-and-nut lock will cause the tight clamping of the door to the casing body of the vending machine simply by turning the handle 5 two or three times.

In case that the slide plate 18 is descended to lower position, the rack 17*a* of the slidable mount 17 is not engaged with the pinion 5*c*, but the leading edge of the rack 17*a* is pushed against the pinion 5*c* by the spring 17*c*, thereby putting the slidable mount 17 in standby condition in which slight rotation of the pinion 5*c* may cause the pinion 5*c* to engage with the rack 17*a* of the slidable mount 17.

After locking the door $m_2$ to the casing body $m_1$ of the vending machine at upper, intermediate and lower levels, a key is used to rotate the inside cylinder of the latchkey 4, and the handle 3 is pushed in the hollow cylinder 2*a* of the handle housing 2 until the grip 12 has been put in the space 2*f* of the handle housing 2. Then, the nail 11*a* is allowed to project from the aperture 2*c* under the influence of the compression spring 11*c*, thus holding the handle 3 in the handle housing 2.

Now, the unlocking operation is described. The door $m_2$ is closed, and then the handle 3 is put in the handle housing 2 (FIG. 2). In this position the handle 3 is decoupled with the bolt assembly 5 with the cross pin 5*d* of the bolt assembly 5 apart from the catch section 3*b* of the handle 3. The key is used to rotate the inside cylinder of the latchkey 4 and hence the cam 15, thereby withdrawing the nail 3*a* from the aperture 2*c* of the handle housing 2*a* to unlock the handle 3. Then, the handle 3 is allowed to project from the handle housing under the influence of the compression spring 10*a*, thereby causing the cross pin 5*d* of the rear end of the bolt assembly 5 to engage with the catch section 6 of the handle 3, permitting rotation of he bolt assembly simultaneous with rotation of the handle 3.

The handle 3 is rotated to disengage the bolt 5 from the nut 7 and at the same time, release the slide plate 18 from the catching means 19. Thus, the door $m_2$ is ready to open (FIG. 13A and 13B).

As may be readily understood from the above, the bolt-and-nut and slide locking mechanism according to the present invention permits the locking of the door to the casing body of the vending machine at three different levels, that is, the upper, intermediate and lower levels along the edge of the door opposite to the edge on which the door is hinged to the casing body of the vending machine, thereby preventing insertion of an iron bar into the gap between the door and the casing body of the vending machine. The tight locking attained by the present invention, also improves the weatherizing of vending machines.

Thanks to the use of specially designed nut assembly having a convergent guide hole and a self-adjustable threaded hole consecutive to the guide hole, the bolt even if not exactly in alignment with the nut assembly, can be guided to the threaded hole of the nut assembly to engage therewith. The thread engagement between the bolt and the nut can be attained simply by insertion, requiring almost no turning of the bolt. The slide lock requires only a slight turn of the bolt enough to move longitudinally the slide plate a distance corresponding to the slot size of the slide plate for latching. The insertion and slight turning of the handle facilitates the locking and unlocking operations of the vending machine.

I claim:

1. A lock for securing a door to a casing body of an automatic vending machine of the type including a nut or female assembly fixed to the casing body; a handle housing fixed to the door or said automatic vending machine; a bolt or male assembly mounted to said handle housing to permit advance movement and thread-engagement with said nut or female assembly; a handle spring-biased outward from said handle housing and equipped with a cylindrical latchkey to permit locking or unlocking of said handle to said handle housing in response to locking or unlocking operation of said cylindrical latchkey, wherein the improvement comprises: a slide locking mechanism including a slide plate which is responsive to rotation of said bolt or male assembly caused by rotation of said handle for sliding longitudinally into engagement with catching means on the casing body of said automatic vending machine, and said handle is equipped with coupling means responsive to the unlocking of said handle from said handle housing for permitting said handle to spring out of said handle housing and at the same time, connect to said bolt or male assembly for rotating and driving said bolt or male assembly into said nut or female assembly.

2. A lock for an automatic vending machine according to claim 1 wherein said nut or female assembly comprises a cylindrical holder having a convergent hole for guiding said bolt or male assembly and a consecutive divergent hole, and a plurality of nut segments each having threads and arranged in said divergent hole so as to yieldingly expand around said bolt or male assembly, encircle and threadedly engage with said bolt or male assembly when said bolt or male assembly is inserted and driven into said nut or female assembly.

* * * * *